US010470562B2

(12) United States Patent
Laing

(10) Patent No.: US 10,470,562 B2
(45) Date of Patent: Nov. 12, 2019

(54) ELECTRICALLY ADJUSTABLE PIECE OF FURNITURE

(71) Applicant: Karsten Laing, Althuette (DE)

(72) Inventor: Karsten Laing, Althuette (DE)

( * ) Notice: Subject to any disclaimer, the term of this patent is extended or adjusted under 35 U.S.C. 154(b) by 0 days.

(21) Appl. No.: 16/047,149

(22) Filed: Jul. 27, 2018

(65) Prior Publication Data

US 2018/0368569 A1 Dec. 27, 2018

Related U.S. Application Data

(63) Continuation-in-part of application No. PCT/DE2017/100069, filed on Feb. 2, 2017.

(30) Foreign Application Priority Data

Feb. 4, 2016 (DE) ..... 10 2016 101 955

(51) Int. Cl.

| | |
|---|---|
| ***A47B 9/16*** | (2006.01) |
| ***A47B 9/00*** | (2006.01) |
| ***A47B 27/02*** | (2006.01) |
| ***A47C 20/04*** | (2006.01) |
| ***A47C 1/024*** | (2006.01) |
| ***A47C 1/03*** | (2006.01) |
| ***A47C 3/24*** | (2006.01) |

(Continued)

(52) U.S. Cl.

CPC ..... *A47B 9/16* (2013.01); *A47B 9/00* (2013.01); *A47B 9/04* (2013.01); *A47B 17/02* (2013.01); *A47B 21/02* (2013.01); *A47B 27/02* (2013.01); *A47C 1/0246* (2013.01); *A47C 1/03* (2013.01); *A47C 3/24* (2013.01); *A47C 17/04* (2013.01); *A47C 19/024* (2013.01); *A47C 20/041* (2013.01); *A47B 2200/0056* (2013.01); *A47B 2200/0057* (2013.01); *A47B 2200/0062* (2013.01)

(58) Field of Classification Search

CPC .. A47B 9/16; A47B 9/20; A47B 17/02; A47B 2200/0056; A47B 2200/0057; A47B 2200/0062

See application file for complete search history.

(56) References Cited

U.S. PATENT DOCUMENTS 8,522,695 B2 * 9/2013 Ellegaard ..... A47B 9/00 108/144.11
9,788,647 B2 * 10/2017 Joshi ..... B60B 33/021

(Continued)

FOREIGN PATENT DOCUMENTS

| | | | |
|---|---|---|---|
| DE | 20 2004 002 924 U1 | 7/2005 |
| DE | 10 2006 013 3479 A1 | 9/2007 |
| WO | WO 2010/112574 A2 | 10/2010 |

OTHER PUBLICATIONS

English translation of DE 202004002924 from espacenet.com (Year: 2019).*

(Continued)

*Primary Examiner* — Daniel J Rohrhoff
(74) *Attorney, Agent, or Firm* — Ronald S. Lombard

(57) ABSTRACT

The invention relates to an electrically adjustable piece of furniture comprising an electric drive motor for adjusting as least one furniture adjusting section with respect to a furniture support section, wherein the piece of furniture comprises sensor devices for detecting the inclination or the change of inclination of the furniture adjusting section.

12 Claims, 6 Drawing Sheets

(51) Int. Cl.

| | |
|---|---|
| ***A47C 17/04*** | (2006.01) |
| ***A47C 19/02*** | (2006.01) |
| ***A47B 9/04*** | (2006.01) |
| ***A47B 17/02*** | (2006.01) |
| ***A47B 21/02*** | (2006.01) |

(56) References Cited

U.S. PATENT DOCUMENTS

| | | | | |
|---|---|---|---|---|
| 10,154,736 | B2 * | 12/2018 | Lin | A47C 31/008 |
| 2015/0120238 | A1 * | 4/2015 | Marvit | A47B 9/00 702/152 |
| 2016/0113391 | A1 * | 4/2016 | Wang | A47B 9/20 248/605 |
| 2016/0309889 | A1 * | 10/2016 | Lin | A47B 9/00 |
| 2017/0055720 | A1 * | 3/2017 | Lin | A47C 31/008 |
| 2018/0279770 | A1 * | 10/2018 | Crowe | A47B 9/16 |
| 2019/0029412 | A1 * | 1/2019 | Gibson | A47B 9/00 |

OTHER PUBLICATIONS

English Translation of the International Search Report for the corresponding international application No. PCT/DE2017/100069; Date of Completion: Apr. 25, 2017; 2 pages.

* cited by examiner

ELECTRICALLY ADJUSTABLE PIECE OF FURNITURE

CROSS-REFERENCE TO RELATED APPLICATION

This is a continuation-in-part application of international patent application PCT/DE2017/100069 filed Feb. 2, 2017 and claiming the priority of German patent application 10 2016 101 955.0 filed Feb. 4, 2016. Both the said international patent application PCT/DE2017/100069 and the said German patent application 10 2016 101 955.0 are incorporated herein by reference in their entireties as though fully set forth.

BACKGROUND OF THE INVENTION

The invention concerns an electrically adjustable furniture piece including at least one electric drive motor for adjusting at least one adjustable furniture section with regard to a furniture support section.

Furniture pieces such as office tables with a height adjustable table plate supported on support legs unto which electric motors are integrated for a motor supported height adjustment of the table plate are known. Such a furniture piece is described for example in WO 2010/112574 A2.

Generally, the electric motors in the table legs are controlled via a manual control mechanism, for example by a switch movable in opposite directions for raising and lowering the table plate. During or after activation of the switch by the user; the electric motors are activated and provide for the desired adjustment movement of the table plate upwardly or downwardly.

DE 20 2004 002 924 U1 describes furniture with electric drive units for adjusting moveable parts of the furniture. Each electric drive unit includes a control unit for processing signals of an inclination sensor by which the momentary inclination of the furniture piece is determined. When the inclination of the furniture piece exceeds a predetermined value, a signal for switching off the respective drive unit or for reversing the drive unit of the electric motor adjustment unit is generated.

Also from DE 10 2006 013 349 A1 a multi-part electrically adjustable furniture piece with an inclination sensor and a drive unit is known wherein, upon reaching a predetermined maximally admissible deviation of the position of a furniture part, for example a table plate, the drive unit is switched off or controlled in the opposite direction.

It is the object of the present invention to simplify the control of an electrically adjustable furniture piece while accurately adjust a demand position.

SUMMARY OF THE INVENTION

The invention relates to an electrically adjustable piece of furniture comprising an electric drive motor for adjusting as least one furniture adjusting section with respect to a furniture support section, wherein the piece of furniture comprises sensor devices for detecting the inclination or the change of inclination of the furniture adjusting section.

The furniture piece may for example be a table with a table leg or table legs which form the furniture support section and a table plate which is adjustable with respect to the table legs in its height and/or inclination. But also other furniture pieces are being considered which have sections that are adjustable by an electric motor, such as chairs, arm chairs, sofas, beds or similar.

The drive unit is controlled by way of a sensor arrangement for recognizing the inclination or the inclination change of the adjustable furniture section. The signals generated by the sensor arrangement are supplied to a controller assigned to the drive motor to control the drive motor in accordance with the signals of the sensor arrangement.

The sensor arrangement makes it possible to initiate or activate manually the control of the drive motor or the drive motors, whereby the adjustable furniture section, for example the table plate, is manually inclined with respect to an initial position, for example by grasping the table edge and pressing it upwardly or downwardly. The inclination or tipping of the adjustable furniture adjustment section is recognized by the sensor arrangement and results in a corresponding control action of the drive motor or drive motors.

The electric drive motors are preferably used directly for the adjustment of the furniture section. Alternatively also hydraulic drive units may be used in which the drive motors are hydraulic pump motors.

The drive motors are preferably of the same type. They are for example all electric or all hydraulic pump motors for the adjustment of an adjustable part of a particular furniture. But alternatively embodiments with different types of drives are possible, for example a combination of an electric drive motor and a hydraulic pump motor.

Advantageously, the direction of the inclination change is converted into an adjustment movement of the furniture part in this same direction, for example in the case if a height-adjustable table, an upward pressure on the table edge is converted into an upward adjustment movement and a downward pressure on the table edge as converted to a downward movement of the table plate.

According to another aspect of the invention which concerns a method for controlling the furniture piece, this initiation or, respectively, activation of the control is achieved by a defined action or movement or, respectively, gesture. This has the advantage that a control action of the drive motor or motors is initiated only when a certain gesture is present which is recognized by the sensor arrangement.

The control is initiated for example in that the furniture section is activated in a predetermined way over a predetermined time, for example, the table edge is pressed one or several times upwardly or downwardly.

If, after the activation, no further confirmation is provided, the activation is canceled.

The initiation of the control and/or the position change of the furniture section may additionally or alternatively be initiated also via an activating device such as a switch or push or rotary button.

The sensor arrangement for recognizing an inclination or inclination change may also be used for a collision recognition, since during a collision of the adjustable furniture section with an object, the inclination of the adjustable furniture section would change, which would be recognized by the sensors and could be used for a control of the electric drive motor or motors. If during the adjustment movement of the furniture adjustment section an unexpected inclination is determined, this indicates a collision, whereupon in the controller control signals are generated for the control of the drive motor or motors and the drive motors are stopped and, if appropriate, operated in the opposite direction.

If a multi-axis sensor is used, movements in several axial directions can be sensed. For example in connection with tables, a change of the angular position about different angle axes, for example in connection with angled desks can be determined.

The embodiment according to the invention is concerned with an electrically adjustable furniture piece with at east two electrically adjustable drive motors which are controlled independently from one another. This includes also a synchronous control of the drive motors. The independent control permits at the same time a different actuation of the drive motors for example for a height adjustment for an uneven floor in order in connection for example with a table to provide for a horizontal level table top. The inclination of the furniture piece is adjusted in this case to a desired inclination.

If several devices are used it may be necessary to synchronize the devices during the adjustment in such a way that a certain surface of the furniture piece, for example a table top remains level during the procedure. By an evaluation of the sensor signals it is possible to control the drives in such a way that they operate synchronously for example so as to maintain a table top level.

The signals of a high-resolution gyroscope sensor and a gravitation sensor which provides an absolute inclination value are combined. The heights of the adjustable furniture section may be determined by a distance sensor which measures the distance to a floor, to a reference object or to the ceiling.

The independent control of the electric drive motor permits a simple setup in particular in that the sensor signals have to be applied only to a part of the electric drive motors. Also in this simplified embodiment a desired inclination position of the adjustable furniture section with respect to the furniture support section can be maintained. The particular electric drive motor which is provided with a sensor arrangement or, respectively, which is controlled dependent on the sensor signals of the sensor arrangement. Performs automatically and independently of the other drive motors compensation movement without sensor signals. By way of the sensor arrangement an inclination or, respectively, inclination change of the adjustable furniture section is determined already during movement of the adjustable furniture section and is compensated for by a corresponding control of the associated electrical drive motor.

It is therefore for example possible to equip the adjustable furniture section, such as a table plate, with two elective drive motors of which however only one elective drive motor is controlled taking into consideration the sensor signals, whereas the second electric drive motor is controlled without taking the sensor signals into consideration. Only by the drive motor, which is controlled by taking the sensor signals into consideration, a desired inclination of the adjustable furniture section can be maintained.

Embodiments wherein each electric motor is provided with its own separate controller as well as embodiments with a common controller for at least two electrical drive motors are possible. In connection with the embodiment with separate controller as well as in the embodiments with a common controller an independent control of the different electric motors is possible.

If the distance sensor is also used for the gesture control, the positive change, which the distance sensor is covered by the gesture device, is calculated via an evaluation of the gravitation sensor signals.

If sensors with several axes are used it becomes also possible to keep for example tables with three or four legs level about both axes.

If drives are synchronized by way of an evaluation of the inclination or inclination change, drive solutions are possible whereby it is no longer necessary that the drives are in communication via a common controller or that they are informed in some other way, for example a bus system, about the activity of the other drives. In this case, each drive is provided with sensors for the determination of the inclination or inclination change and they ensure independently that a table plate is for example maintained level. It may be sufficient that only one of the drives includes an arrangement by which the user initiates the desired adjustment while the other drives follow automatically.

With an appropriate arrangement and distribution of this electric drive motors a desired inclination of the adjustable furniture section can be provided for, for example, in connection with a desk or a table, a desired desk top inclination or table top inclination.

The sensor in the sensor arrangement for determining the inclination or, respectively, inclination change is for example in the form of a gyroscope sensor via which a rotation or respectively, a change in the angular position of the adjustable furniture section can be determined. In addition or alternatively the sensor may also be in the form of a gravitation sensor via which the absolute inclination of the adjustable furniture section can be determined. By an integration of the rotation of the adjustable furniture section over several subsequent points in time it is possible to determine the inclination of the adjustable furniture section. Into a consideration may also be taken embodiments wherein the sensor arrangement comprises only a single sensor for the determination of the inclination, as well as embodiments with several sensors for determining the inclination which sensors are of an identical or a different design.

In accordance with a further embodiment the sensor arrangement comprises a sensor for recognizing a touch-free control gesture, via which the drive motor can be controlled. The touch-free sensor may furthermore be used for measuring the distance between the adjustable furniture section and reference point. The reference point permits to determine either the absolute height or the relative height of the adjustable furniture section.

The detection and comprehension of the control gestures which are executed by a user in the sensing range of the sensor arrangement by a body movement, for example a hand or foot movement or the movement of an object serves on one hand for switching on or off the electric drive motor and, on the other hand, for controlling the drive motor to run in the desired rotational direction. If desired also the drive speed of the drive motor may be controlled by a certain gesture. On one hand, this permits to activate the drive motor with a predetermined control gesture so that an accidental gesture in the recognition or experience range of the sensor arrangement does not lead to an activation of the drive motor or motors. On the other hand, it is possible to activate the drive motor or motors by gestures in a certain way, that is to change the direction in which the adjustable furniture section should move and also the speed of movement.

The sensor arrangement is part of a control arrangement with a controller in which the sensor signals of the sensor arrangement are processed and the control signals for controlling the drive motors are generated. The control arrangement may be integrated into the drive motor or it may be arranged outside the drive motor.

The invention and suitable embodiments thereof will be described below in greater detail with reference to the accompanying drawings.

DETAILED DESCRIPTION OF THE INVENTION

Figure 2:
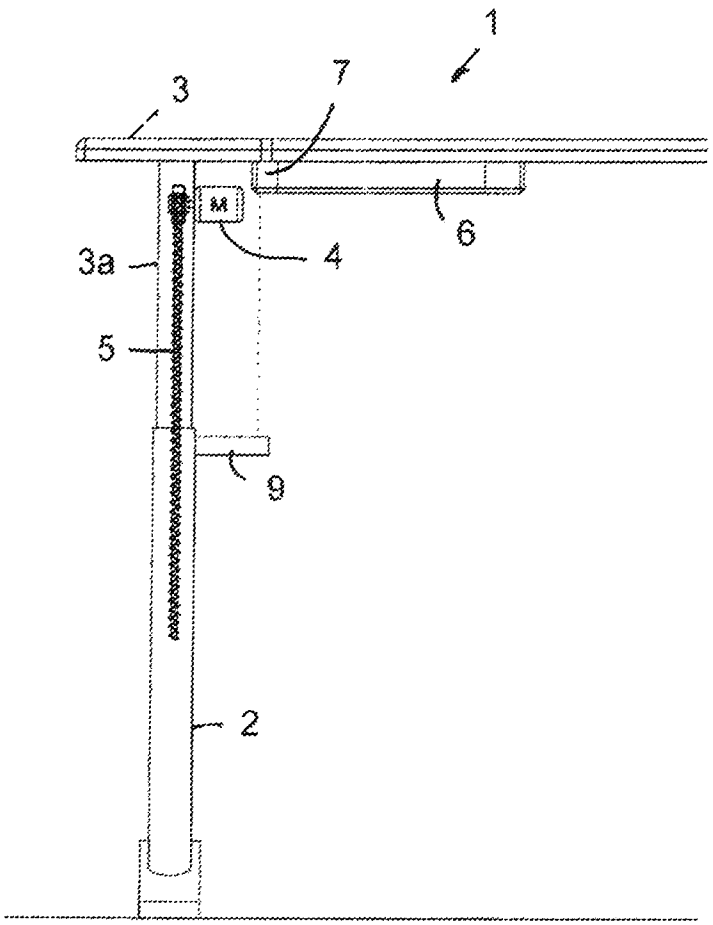
FIG. 2 shows the table according to FIG. 1 with the table top in a raised position.
Figure 1:
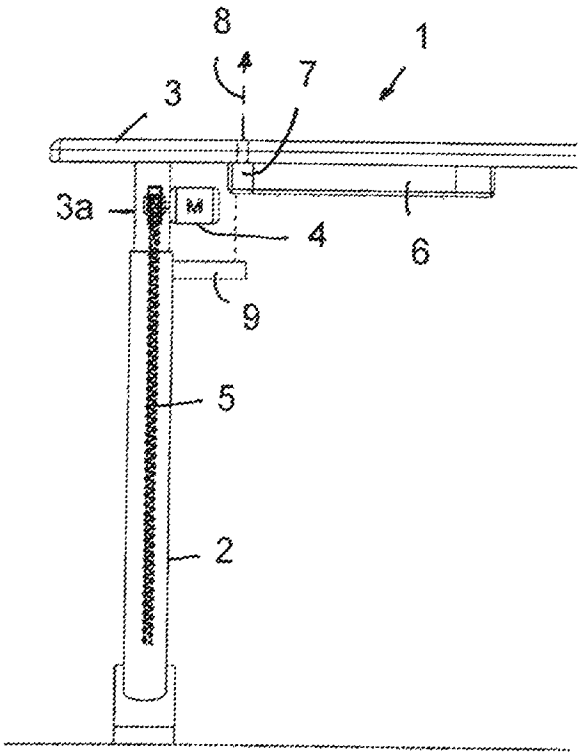
FIG. 1 shows in a side view as an adjustable furniture piece a section of a table whose table plate is height-adjustable with respect to the table legs by an electric drive motor.

FIGS. 1 and 2 show as exemplary embodiments for a furniture piece: a table 1 with a table plate 3 and a table leg 2. The table leg 2 forms a furniture movement section and the table plate 3 forms a adjustable furniture section wherein the table plate 3 is height-adjustable with respect to the table leg 2. The height adjustment occurs with the aid of an electric motor 4 which is arranged at the bottom side of the table plate 3 on a guide portion 3*a* which extends into the table leg 2 and is slidable guided in the table leg 2. The drive motor 4 rotates a threaded shaft 5 which is in engagement with a corresponding thread in the table leg. The shaft 5 is supported by the guide section 3*a* whereby, upon rotation of the shaft, a desired height adjustment of the table plate 3 is obtained.

At the bottom side of the table plate 3 there is a control arrangement 6 by which this electric drive motor 4 is controlled. The control arrangement 6 comprises a controller as well as a sensor arrangement 7 whose sensor signals are processed in this controller to provide control signals by which the drive motor 4 is controlled. The electric drive motor 4 can be controlled to rotate in either direction in order to cause movement of the table plate 3 up- or downwardly.

The sensor arrangement 7 comprises a sensor which works without being contacted, for example an optical sensor, an ultrasound sensor, an infrared sensor or a capacitive sensor wherein, if appropriate, several sensors of the same or a different type may be combined. As indicated by the arrow 8, the sensor arrangement covers the area above the table plate 3. The sensor of the sensor arrangement 7 covers an area which is dependent on the sensor and on the installation location. A body part or object by which a control gesture is executed and which extends into the sensing area is detected and results in a control of the drive motor.

As control gesture, for example, an upward or a downward movement is performed within the sensing range of the sensor arrangement 7, wherein, via a continuous measuring of the distance between the sensor arrangement 7 and the body part or respectively, the object within the sensing range, also the direction and the speed of the body part or respectively, the object can be determined.

The control gesture is detected by the sensor arrangement 7 in a contact-free manner. In principle, the body part or respectively the object may be disposed directly on the top surface of the table plate 3, whereby, also in this case, there is a distance between the object and the sensor arrangement 7 which is arranged at the bottom side of the table plate. Typically however the control gesture is performed at a distance from the top side of the table plate 3.

The sensor arrangement 7 however may also be arranged on the top side of the table plate and cover the area above the table plate.

For controlling the sensor the control arrangement 6 first needs to be activated by an activation gesture in order to facilitate the subsequent control procedure. The activation or respectively, the initiation of the control is achieved for example in that the controlling body part or, respectively, object is held at a predetermined distance from the sensor arrangement 7 for a predetermined time. This activation can be optically indicated for example by an LED, wherein such an optical indication is switched off after a certain time when the activation is not followed by a further gesture.

After activation the position of the table plate 3 can be changed by a position-change-control gesture, in particular by an upward movement for a raising of the table plate 3 and a downward movement for a lowering of the table plate 3. The adjustment movement is preferably stopped by discontinuing the control gesture, for example, by removing the controlling body part from the sensor area. This procedure has the advantage that the adjustment movement of the table plate occurs synchronously with the control gesture.

The contact-free sensor arrangement 7 may additionally be used for measuring the distance between the table plate 3 and a reference projection 9 on the table leg 2. The reference projection 9 is a transverse projection at the upper end of the table leg 2 which projection extends in the downwardly extending sensing area of the sensor arrangement 7. The distance between the table plate 3 and the reference projection 9 can be used as basis sensing as reference, in particular for a standard or desired height of the table plate with respect to which the relative adjustments are performed. The distance measurements can be performed by a second sensor arrangement or a second sensor of the sensor arrangement, so that for example the area above and below the table plate can be sensed.

Figure 3:
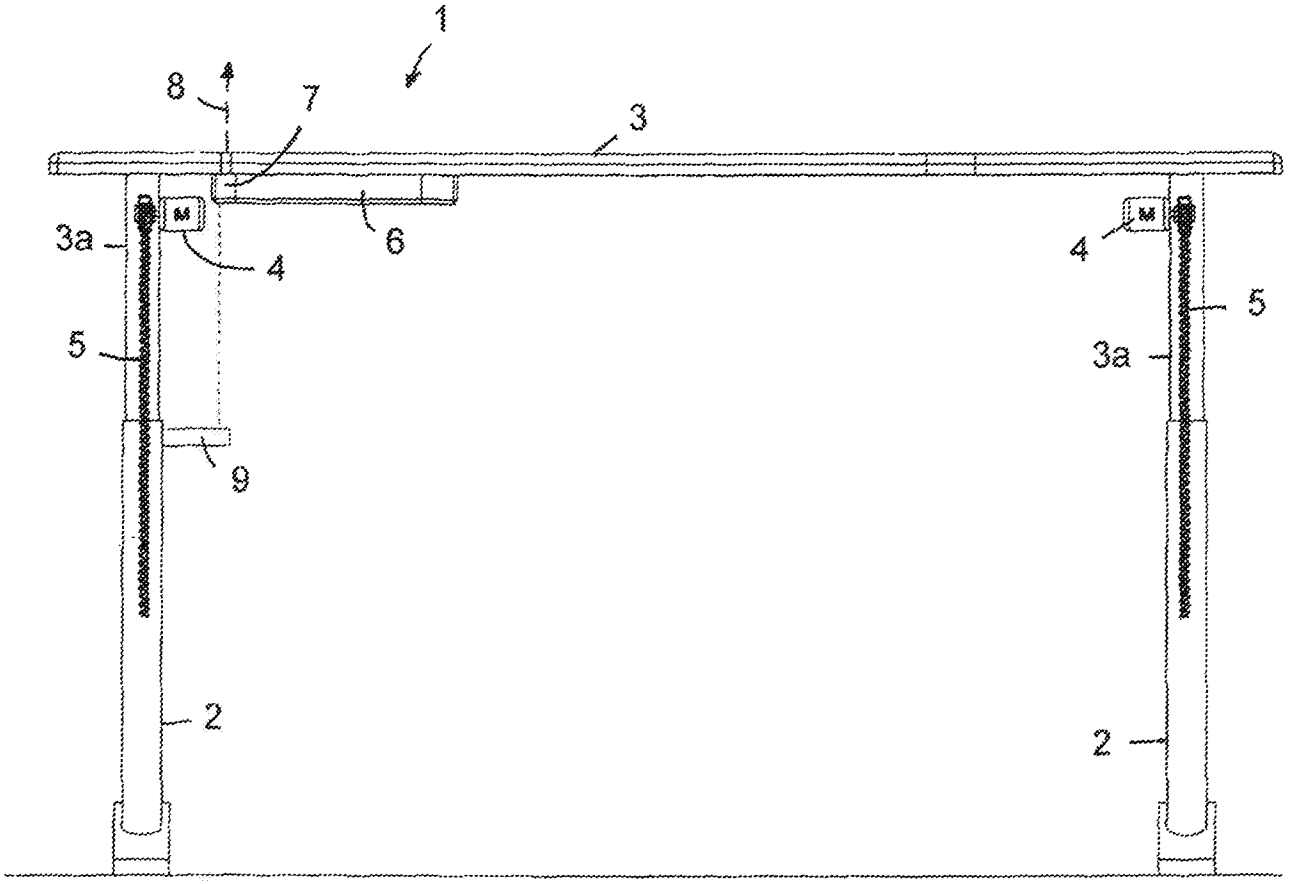
FIG. 3 is a side view of a complete table with left and right side legs and an electric drive motor in each leg.

FIG. 3 shows a whole table 1 with two legs 2 which together support the table plate 3. Each table leg 2 accommodates a guide portion 3*a* which extends from the bottom side of the table plate 3 and carries each an electric drive motor 4, via which the respective guide portion 3*a* is height-adjustable with respect to the associated table leg 2. The two electric motors 4 are both controlled by the control arrangement 6 which comprises a contact-free sensor arrangement 7. The gesture control via the sensor arrangement 7 occurs as described in connection with exemplary embodiment of FIGS. 1 and 2 by manual gesturing in the sensitive area indicated by FIG. 8 above the sensor arrangement 7 and above the top side of the table plate 3.

The two electrical drive motors 4 may be synchronously controlled via a common control arrangement 6. Also an independent control of the two electric drive motors is possible. This permits for example to arrange for a desired inclination of the table plate 3 or for example for a horizontal arrangement of the table plate in spite of an uneven floor or for a predetermined desk inclination. If several sensors are provided in the sensor arrangement several degrees of freedom of movement of the table plate 3 can be determined and the table plate 3 can be adjusted via different control motors to the desired values.

This can also be achieved by gestures for the control of one or several sensors. To this end, for example, a long activation position is provided for an actuation in a first direction of movement and a short activation position for an actuation in a second direction of movement. The respective activation can be indicated optically for example by way of an LED in different colors or by blinking signals.

Figure 4:
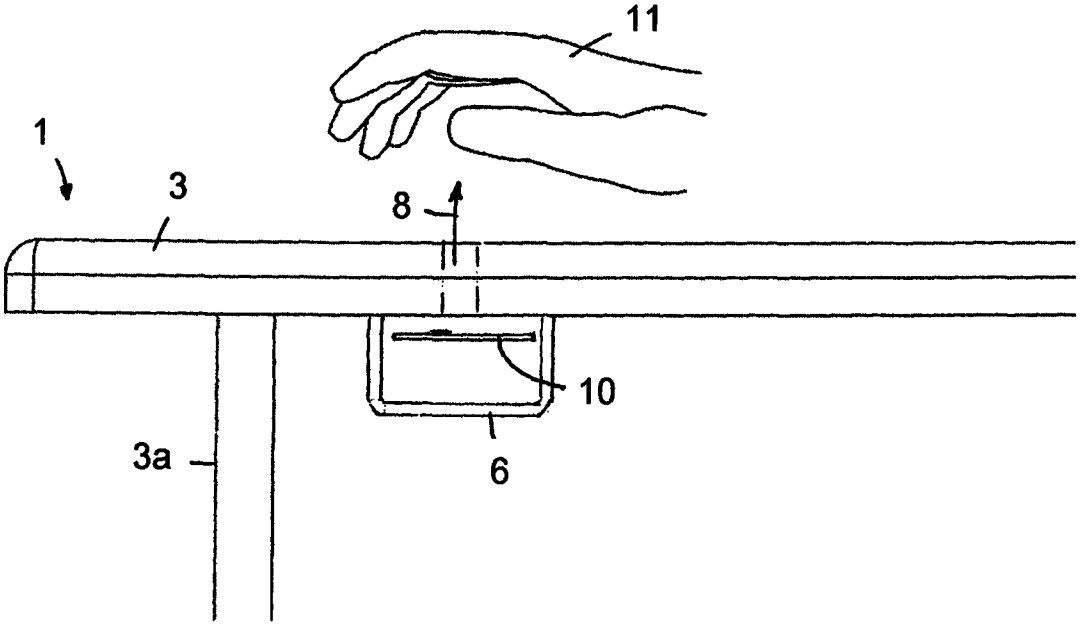
FIG. 4 shows a table plate with a sensor arrangement for recognizing a contact-free control gesture generated by the hand of a user.
Figure 5:
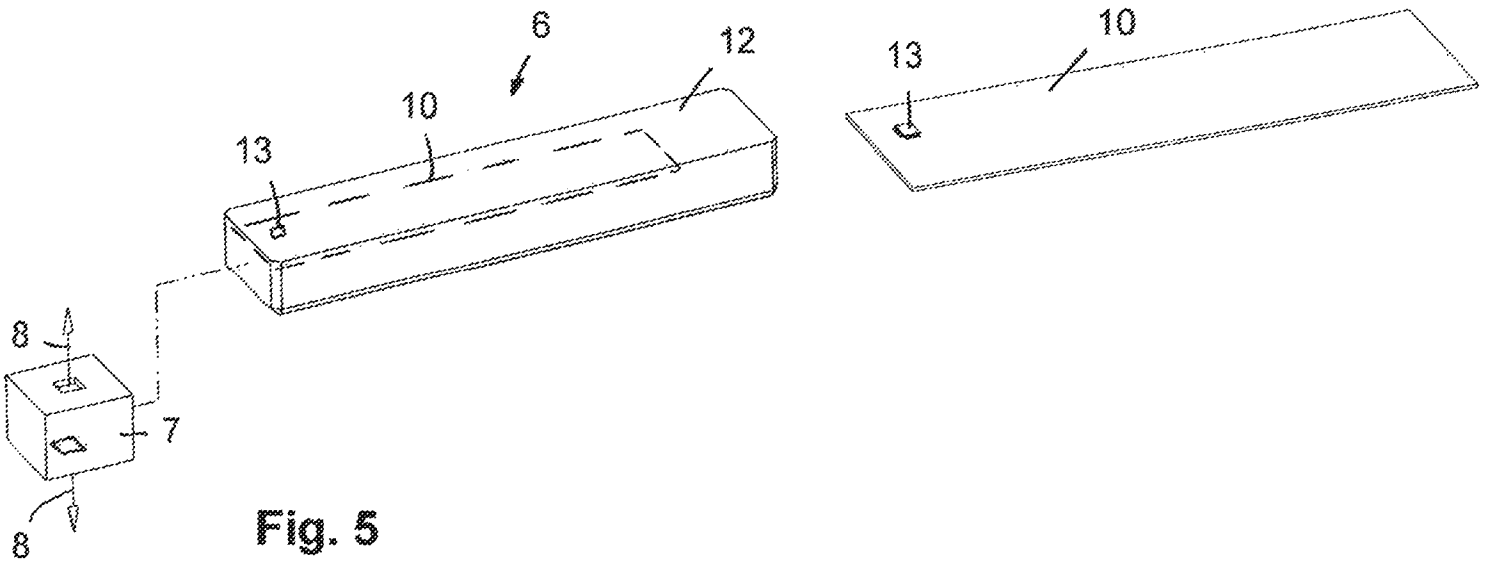
FIG. 5 shows, in an exploded view, a control arrangement for controlling an electric drive motor including a controller and a separate sensor.

In FIGS. 4 and 5 the set-up and the operation of the control arrangement 6 are shown. The control arrangement 6 comprises a controller 12 with a plate which carries a microchip or, respectively, a microcontroller 13, and a sensor arrangement 7 with a contact-free sensor whose sensing range extends upwardly or, respectively downwardly as indicated by the arrows 8 (see FIG. 5). The sensor signals of the sensor arrangement 7, which represent the distance to the hand or the foot or an object placed into the sensing space by a user, are processed in the controller in which control signals based on the sensor signals are generated for controlling the electrical drive motor or motors. The sensor may either be integrated into the controller or arranged outside the controller but communicates with the controller for transferring the measured sensor signals. An arrangement outside and independent from the controller facilitates positioning the sensor at a location which is optimal for servicing the sensor. The connection between the sensor and the controller is established via cable or by wireless signal transmission.

Figure 8:
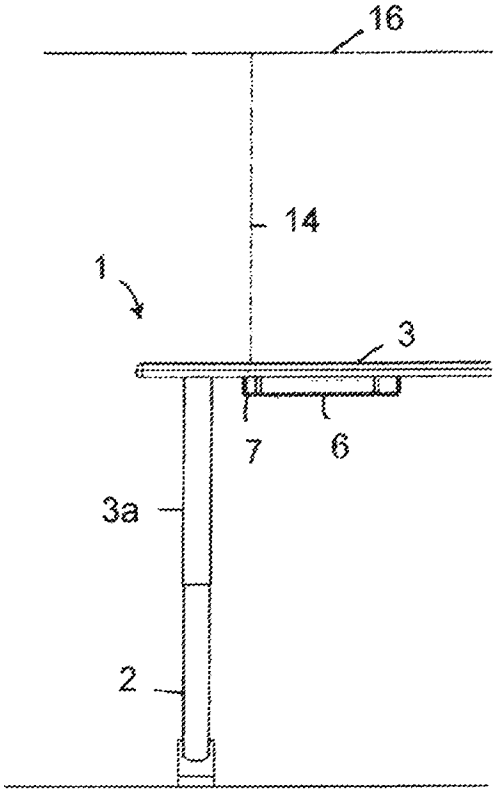
FIG. 8 shows a further embodiment of a table with a height-adjustable table plate and a sensor arrangement which is activated contact-free and which can be used for determining the height of the table plate with respect to the ceiling; and, FIG. 9 shows, in a perspective view, a table with three table legs wherein the table plate is height adjustable by drive motors arranged in each table leg.
Figure 7:
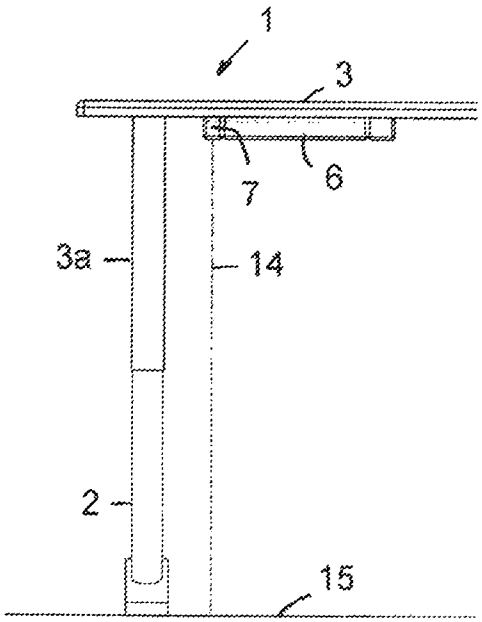
FIG. 7 shows another embodiment of a table with a contact-free sensor arrangement for determining the height of the table plate with respect to the floor wherein the sensor arrangement is additionally useable for gesture control.
Figure 6:
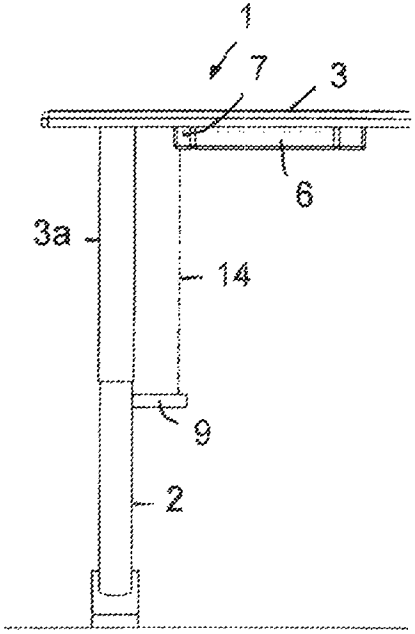
FIG. 6 shows a table with a height-adjustable table plate and a sensor arrangement which operates contact-free for determining the height of the table plate with regard to the table leg.

In FIGS. 6 to 8 exemplary embodiments of arrangements for determining the distance between the table plate 3 and a fixed reference point are shown wherein the distance determination without contact is achieved with the aid of the sensor arrangement 7. The distance determination can also be combined with the gesture control. In that case, during the gesture control, a distance change is not determined via the distance sensor but via the sensors contained in the drive motors as they are calculated from the acceleration values obtained from an acceleration sensor or gravitation sensor.

In accordance with FIG. 6 like in the exemplary embodiment of FIGS. 1 and 2 the distance between the sensor arrangement 7 on the bottom side of the table plate 3 and a reference projection 9 projecting from the table leg 2 below is determined in a contract-free manner.

As indicated in FIG. 7 the distance between the sensor arrangement 7 and the floor 15 is measured and used as reference.

As indicated in FIG. 8 the distance to the ceiling of the room in which the table stands is determined via the sensor arrangement 7 and the distance 14 is used as reference. To this end, an opening is provided in the table plate 3 like in connection with all the other embodiments with gesture control from above the table plate in which the sensor range of the sensor arrangement 7 on the bottom side of the table plate 3 extends through that opening. However, the sensor may also be integrated into the table plate or arranged on the top side of the table plate.

Figure 9:
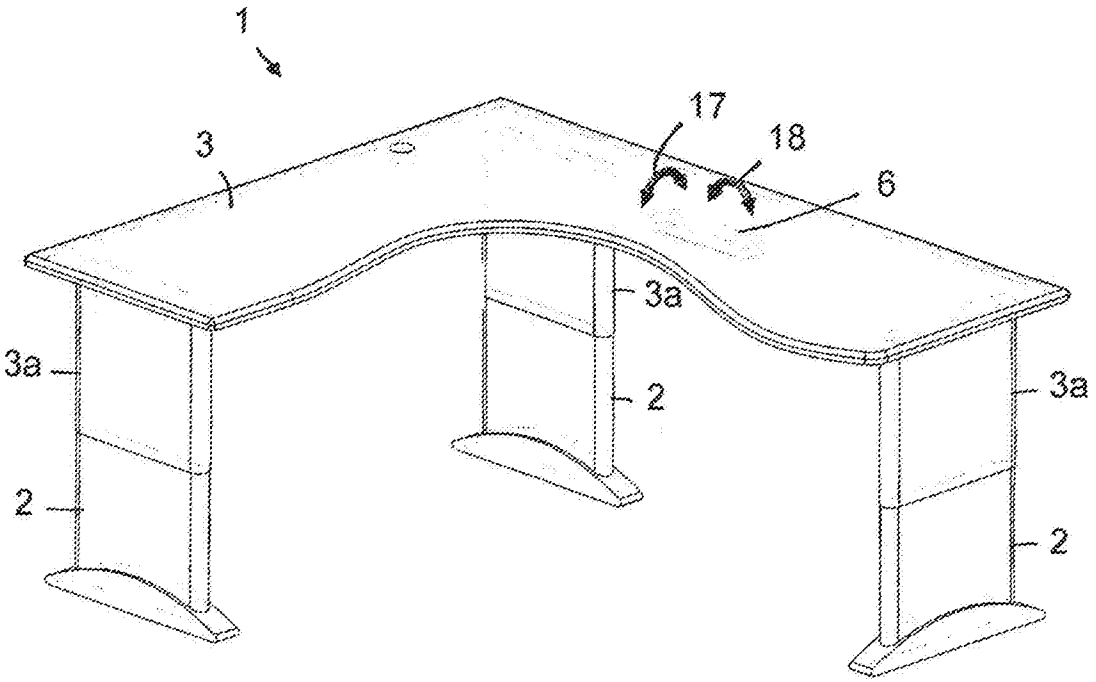

A further embodiment is shown in FIG. 9 wherein the table plate of the table 1 extends over a corner area and the table plate is supported by three legs 2. In each case, a guide part 3*a* which is firmly connected to the bottom side of the table plate is arranged so as to extend over a table leg 2 to make it height adjustable in each case by an electric drive motor. There are all together three drive motors which can be controlled independently from one another by a common control arrangement 6.

The control arrangement 6 comprises preferably at least two individual sensors effective in a sensor direction via which a tipping or an inclination of the table plate 3 around the axes extending horizontally in the plane of the table plate 3 can be determined. To this end, the control arrangement 6 includes a sensor arrangement with at least two sensors which are designed to determine the inclination or respectively, inclination change of the table plate. These sensors are gyroscope sensors and/or gravitation sensors wherein, via the gyroscope sensors, the inclination angle change or respectively the tilting speed of the table plate 3 and via the gravitation sensors the absolute inclination and the acceleration of the table plate 3 can be determined. If over time continuous measurements are performed, the inclination charge of the table plate can be determined via both types of sensors. The combination of gyroscope and gravity sensors is also advantageous for an accurate position control.

The inclination determination via the sensor arrangement allows for different types of functions. On one hand, it becomes possible to recognize a collision by interpreting a sudden inclination change during upward or downward movement of the table plate 3 as a collision with same object, which leads to a stop of the adjustment movement of the table plate 3 and a collision with same object, which leads to a stop of the adjustment movement of the table plate 3 and possibly to a reversal of the adjustment movement into the opposite direction.

On the other hand, by pressing the table edge upwardly or downwardly, a drive motor supported raising or lowering movement of the table plate can be generated. The upward or downward pushing of the table edge results in a corresponding inclination change of the table plate 3 which is processed sensorically and in the control arrangement for generating control signals for the drive motors. The drive motors can be controlled via the control arrangement individually and independently from one another—which also includes a synchronous control.

In addition to a raising or, respectively, lowering of the table plate 3, if appropriate, also a desired desk inclination of the table plate 3 can be adjusted. In both cases it is necessary to initiate an activation cycle for a achieving the movement, for example by pressing the table plate once or several times up or downwardly. The activation can also be achieved by an acoustic or optical activation signal, where upon the movement can be initiated by pressing the table plate edge upwardly or downwardly.

It is furthermore possible to compensate for height differences in the three different table legs via a separate control of the drive motors, for example in order to obtain a table plate 3 which is standing in water in a horizontal alignment

What is claimed is:

1. An electrically adjustable piece of furniture with at least two electrical drive motors (4) for adjusting at least one adjustable furniture section (3) with respect to a furniture support section (2), the furniture piece (1) including a sensor arrangement (7) for sensing an inclination or inclination change of the adjustable furniture section (3) and the drive motors (4) being controllable dependent of the inclination or inclination change, but independently of one another, and the sensor arrangement (7) including at least one gyroscope sensor for determining the inclination or inclination change of the furniture section (3) and at least one gravitation sensor via which the absolute inclination of the furniture section (3) can be determined, and, wherein only a part of the drive motors (4) is controlled dependent upon the sensor arrangement (7) and at least one of the drive motors (4) is void of control dependent on the sensor arrangement (7).

2. The furniture piece according to claim 1, wherein via a control of one of the drive motors (4) the direction of the inclination change is convertible to an equally directed control movement.

3. The furniture piece according to claim 1, wherein in the case the inclination or the inclination change exceeds an acceptable value, one of the drive motors (4) is to be stopped or controlled as to rotate in the opposite direction.

4. The furniture piece according to claim 1, wherein a desired inclination of the furniture adjustment section (3) obtainable by controlling at least one of the drive motors (4).

5. The furniture piece according to claim 1, wherein the sensor arrangement (7) further for recognizing a contact-free control gesture, by which one of the drive motors (4) is controlled.

6. The furniture piece according to claim 1, wherein the sensor arrangement (7) further for a contact-free measuring of a distance between the adjustable furniture section (3) and a reference point.

7. The furniture piece according to claim 1, wherein for each of the electric drive motors (4) a separate controller is provided.

8. The furniture piece according to claim 1, wherein a common controller is provided for the at least two electric drive motors (4).

9. A method for controlling a furniture piece according to claim 1, wherein at least one of the drive motors (4) is controlled depending on a detected inclination or respectively inclination change.

10. The method according to claim 9, wherein at least one of the control and the position change of the furniture adjustment section (3) is initiated by a predetermined movement in the sensory range of the sensor arrangement.

11. The method according to claim 9, wherein at least one of the control and the position change of the furniture adjustment section (3) is initiated via an activating arrangement including a switch or a pressure button or rotatable button.

12. The method according to claim 9, wherein based on the sensor data of a gyroscope sensor the drive motors are synchronized for adjusting the inclination or the inclination change of the adjustable furniture section (3) and the inclination is corrected using the sensor data of a gravitation sensor while the height of the adjustable furniture section (3) is adjusted via a distance sensor.

* * * * *